US009605631B2

(12) United States Patent
Zirkelbach

(10) Patent No.: US 9,605,631 B2
(45) Date of Patent: Mar. 28, 2017

(54) SILENCER

(71) Applicant: Mahle International GmbH, Stuttgart (DE)

(72) Inventor: Thomas Zirkelbach, Tamm (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 14/910,682

(22) PCT Filed: Aug. 7, 2014

(86) PCT No.: PCT/EP2014/067022

§ 371 (c)(1),
(2) Date: Feb. 5, 2016

(87) PCT Pub. No.: WO2015/018910

PCT Pub. Date: Feb. 12, 2015

(65) Prior Publication Data

US 2016/0195049 A1 Jul. 7, 2016

(30) Foreign Application Priority Data

Aug. 8, 2013 (DE) ..... 10 2013 215 636

(51) Int. Cl.
*F02M 35/10* (2006.01)
*F02M 35/12* (2006.01)

(52) U.S. Cl.
CPC ..... *F02M 35/1216* (2013.01); *F02M 35/10* (2013.01); *F02M 35/10111* (2013.01); *F02M 35/1261* (2013.01); *F02M 35/1272* (2013.01); *F02M 35/1283* (2013.01)

(58) Field of Classification Search
CPC ..... F02M 35/1216; F02M 35/10; F02M 35/10111; F02M 35/1261; F02M 35/1272; F02M 35/1283
USPC ..... 181/229
See application file for complete search history.

(56) References Cited

U.S. PATENT DOCUMENTS 5,783,780 A 7/1998 Watanabe et al.
7,802,651 B2 9/2010 Park et al.
8,132,552 B2 * 3/2012 Matsumoto ..... F02M 35/1238 123/184.61
8,528,692 B2 9/2013 Teshima
(Continued)

FOREIGN PATENT DOCUMENTS

DE 10026355 A1 1/2002
DE 10058479 A1 5/2002
(Continued)

OTHER PUBLICATIONS

English abstract for EP-1403506.
(Continued)

*Primary Examiner* — Forrest M Phillips
(74) *Attorney, Agent, or Firm* — Fishman Stewart PLLC

(57) ABSTRACT

A silencer, for example an intake silencer for an internal combustion engine, may include a pipe for conducting a gas mixture. The pipe may be perforated at least in some regions. An absorption layer may at least partially surround the pipe for absorbing a sound transmitted by the gas mixture. An outer casing may encase the pipe. The outer casing may be perforated at least in some regions and may surround the absorption layer.

20 Claims, 5 Drawing Sheets

(56) References Cited

U.S. PATENT DOCUMENTS

| | | | | |
|---|---|---|---|---|
| 2004/0069563 | A1* | 4/2004 | Zirkelbach | F01N 1/026 181/269 |
| 2006/0027204 | A1 | 2/2006 | Vogt et al. | |
| 2008/0230306 | A1 | 9/2008 | Ichikawa | |
| 2008/0230307 | A1 | 9/2008 | Matsumoto et al. | |
| 2008/0236938 | A1 | 10/2008 | Pettipiece | |
| 2009/0178879 | A1* | 7/2009 | Park | B01D 46/10 181/224 |
| 2010/0132649 | A1* | 6/2010 | Zirkelbach | F16L 55/033 123/184.53 |
| 2011/0107994 | A1* | 5/2011 | Satarino | F02M 35/10144 123/184.21 |
| 2012/0292127 | A1* | 11/2012 | Teshima | F02M 35/10144 181/224 |
| 2012/0292128 | A1 | 11/2012 | Keesser et al. | |
| 2015/0152818 | A1* | 6/2015 | Fischer | B60R 21/34 55/385.3 |

FOREIGN PATENT DOCUMENTS

| | | | |
|---|---|---|---|
| DE | 102004007109 | A1 | 9/2005 |
| EP | 1170499 | A1 | 1/2002 |
| EP | 1403506 | A2 | 3/2004 |
| EP | 1541856 | A1 | 6/2005 |
| EP | 1624180 | A2 | 2/2006 |
| EP | 2541034 | A1 | 1/2013 |
| FR | 2814778 | A1 | 4/2002 |
| JP | 2007-016652 | A | 1/2007 |
| WO | WO-97/09527 | A1 | 3/1997 |

OTHER PUBLICATIONS

English abstract for EP-2541034.
English abstract for JP2007-016652.
English abstract for FR2814778.
English abstract for DE102004007109.
English abstract for DE10058479.
English abstract for DE10026355.

* cited by examiner

SILENCER

CROSS-REFERENCE TO RELATED APPLICATIONS

This application claims priority to German Patent Application No. 10 2013 215 636.7, filed Aug. 8, 2013, and International Patent Application No. PCT/EP2014/067022, filed Aug. 7, 2014, both of which are hereby incorporated by reference in their entirety.

TECHNICAL FIELD

The present invention relates to a silencer, in particular an intake silencer for an internal combustion engine, and to an intake system for a motor vehicle comprising such an intake silencer. The invention further relates to an advantageous production method for such silencers.

BACKGROUND

Any heat engine that performs work through internal combustion of fuel is designated as internal combustion engine. For this purpose, chemical energy from a mixture of fuel and ambient air is converted into mechanical energy by igniting said mixture in a work space of a work cylinder known as combustion chamber or combustion space. In addition to so-called continuous-flow machines or turbomachines, internal combustion engines known from the prior art, for example gasoline engines or diesel engines comprised by the equipment of conventional motor vehicles, operate according to this functional principle. For intaking ambient air and discharging combustion exhaust gases, generic motor vehicles usually are provided with intake and exhaust systems which are fluidically connected to the combustion engine, wherein said exhaust systems are also designated as exhausts in automotive engineering.

In addition to a Y-pipe, exhaust manifold and tailpipe, an exhaust for a gasoline engine known from the prior art comprises a device for reducing noise emission as it occurs in particular in the form of outlet noises of the tailpipe. For this purpose, such devices, which are known as mufflers in vehicles acoustics, can be arranged downstream of, e.g., an optionally required catalytic converter of the exhaust system, which catalytic converter, for its part, effects additional sound absorption. Attaching generic mufflers is carried out by means of appropriate mounting points on the vehicle floor.

For example, DE 100 26 355 A1 discloses a sound damping air duct for an intake duct for an air intake passage of an internal combustion engine, in particular of a motor vehicle, comprising an inner pipe that has radial openings, and comprising a sound damping cladding that encloses at least partially the inner pipe radially on the outside. In order to improve the sound-absorbing effect of this air duct, there is provided an outer pipe which completely radially encloses the inner pipe and the sound-absorbing cladding.

Also, in DE 100 58 479 A1, a wide band damper for the intake air of an internal combustion engine is proposed. This wide band damper is particularly suitable for damping the intake noise caused by the compressor for intake air. The damper is formed by a duct section which is connected to a resonant volume by means of passages. The resonant volume can annularly surround the duct section. Absorption material for improving the sound absorption is provided within the resonant volume. Furthermore, it is provided that a barrier layer is arranged between the absorption material and the passages, which barrier layer can be composed of fleece or a foil. This prevents the absorption material from being blown into the intake air where the parts of the absorption material could damage the engine. In this manner, it is intended to enable the production of a wide band damper that is cost-effective and effective over a wide band.

Furthermore, known from DE 10 2004 007 109 A1 is a silencer for an air flow channel, wherein the sound-transmitting channel is provided with openings, the length of which in the flow direction and the width of which are within a predefined size range, wherein based on a predefined opening area of the slot-like openings, a ratio of the length of the openings to the width thereof is selected, which is selected in dependence on a specific frequency range of the sound emission to be dampened, wherein the openings at the rear end as viewed in the flow direction are directed inwardly and have guiding edges protruding into the flow channel.

EP 1 170 499 A1 in turn discloses another noise reduction arrangement for air ducts. A conduit for the intake system of an internal combustion engine is formed by means of an extrusion method. The surface of the conduit is provided with orifices to allow the passage of air therethrough. This prevents the formation of standing waves in the system and thus reduces the resulting noise. The orifices can be pierced during the extrusion of the conduit and can be in the form of holes or slits. The orifices can be arranged on the conduit in a regular pattern, such as in rows, hoops or helices, or in a random pattern, or in a combination of different patterns. The orifices can also be concentrated in specific areas on the pipe surface to improve the acoustic characteristics of the pipe.

In contrast, EP 1 541 856 proposes to provide specific regions of the sound transmitting air conduit in an intake pipe of an internal combustion engine, which intake pipe serves as the sound-transmitting conduit in the curved region thereof, with slit-like orifices, the length of which in flow direction and width of which are dimensioned according to a predetermined size. Based on a predetermined orifice area of the slit-like orifices, a ratio of the length of the orifices to their width is selected in dependence on a specific frequency range of the sound emission to be absorbed. Furthermore, a closable flap is provided at the intake pipe of the internal combustion engine, which flap can be placed over the slit-like orifices provided in the curved region.

Also, from FR 2 814 778 A1, a pipe is known that has at least one porous section which, for its part, is provided with a slit that serves for reducing the noise produced by the fluid flow.

Finally, WO 1997 009 527 A1 discloses an air intake duct for a so-called reflection silencer usable in motor vehicles, which air intake duct is located between the turbocharger and the internal combustion engine and which is provided internally with screens or walls, the openings of which are at least the internal diameter of the inlet and of the outlet and align therewith. The spaces between the screens form resonance chambers for the air flowing therethrough. By choosing different opening diameters and/or different screen distances, a damping of in excess of 20 dB(A) can be achieved through a broadband in the range from 1 kHz to 5 kHz.

A disadvantage of these known devices is in some cases their one-sided optimization in view of a reduction of the outlet noise of the intake system or the absorption of certain sound frequencies.

SUMMARY

It is therefore an object of the invention to create a silencer, an intake system and a production method for silencers which are characterized by a reduction of the outlet sound of the intake system over the greatest possible bandwidth of occurring frequencies.

This object is achieved by a silencer, an intake system and a production method, as disclosed herein.

The fundamental idea of the invention is to encase a perforated pipe for the gas mixture to be transported with a suitable absorption layer which, for its part, is enclosed by an outer casing which is perforated as well. Due to the perforation of the pipe, the described combination of two noise reduction techniques allows, in a first step, an advantageous reduction of the outlet sound in low frequency ranges, while the absorption layer surrounding the pipe, in a second step, primarily eliminates the remaining high-frequency oscillations of the gas mixture to the greatest possible extent without resulting in intake of hot air.

This means that sound absorption or sound dampening results from the overall construction, which is implemented in the manner of a "sandwich" composed of perforation, absorption layer and perforation. Dampening in the low-frequency range, i.e. at frequencies up to approx. 1000 Hz or 1500 Hz, is carried out mainly or predominantly by the respective perforation, while the effectiveness of the absorption layer increases with increasing frequency and dampens or absorbs predominantly in the high-frequency range from 1000 Hz or 1500 Hz and higher. Thus, absorption in the entire audible range and/or effective dampening of the audible sound can be achieved by this construction.

The respective perforation includes a number of perforation holes. The perforation holes can have any shape and/or size and can be arranged in an arbitrarily distributed manner.

Preferred are configurations in which the perforation holes have a round shape. Furthermore, it is preferred that at least two of the perforation holes have the same shape. This increases the acoustic advantages. In addition, producing the perforation is simplified.

In advantageous variants, at least one such perforation hole has a size of less than 7 mm. This means that the round perforation hole has a diameter of less than 7 mm. Particularly preferred are embodiments in which at least one such perforation hole has a size of less than 2 mm. In this context it applies that the smaller the perforation hole or the perforation holes, the better are the acoustic, in particular, sound-absorbing properties of the silencer.

In a preferred embodiment, such a silencer can be used as an intake silencer for the intake system of a combustion engine, such as an internal combustion engine. In its function as an intake silencer, the silencer can be fluidically connected to an intake line or an air filter of the respectively equipped intake system. The described configuration as an intake silencer enables the silencer to contribute, in a manner fluidically adapted to the internal combustion engine, to the reduction of the pulsating intake flow—which is caused by the reciprocating piston or pistons of the engine—of raw air.

Particular attention is being paid to the absorption layer which can be formed by a porous sound-absorbing material. The use of such a material enables the effective transformation of the sound energy transported by the gas mixture into heat energy which results from the friction between the gas molecules and the pores of the sound-absorbing material.

Foam material is particularly suitable here as a sound-absorbing material. The high compressibility of this material allows reducing the volume of the absorption layer under pressure in the course of the production process, which proves to be helpful from a manufacturing practicality point of view. Moreover, since an absorption layer based on foam material exhibits only low strength, it is characterized by very low density and thermal conductivity and ensures uncomplicated machinability with minimal tooling costs. Finally, the absorption layer made from foam material is virtually free of residual stress.

A suitable alternative to foam-based materials is an embodiment of the absorption layer made from fleece material. Using such a fibrous web, in particular in the form of a flexible textile fabric, allows a great design variety of absorption layers according to the invention, which, due to the plurality of raw materials and production variants usable for fleece production, can be specifically adapted to a wide spectrum of application requirements.

According to an advantageous embodiment, the absorption layer is provided with such an absorption region that the absorption layer absorbs high-frequency oscillations of the gas mixture in the audible range to the greatest possible extent. Corresponding high-frequency tonal noises such as broadband noise components, whistling or squeaking noises which are particularly unpleasant for vehicle passengers and other road users, can already be effectively reduced in this manner before exiting the outlet of the intake system in that the oscillation energy of the frequencies in question carried by the gas mixture are at least partially transformed into heat energy within the absorption layer. In combination with a suitable perforation of the pipe, which can supplement the effect of the absorption in a low-frequency range, a silencer according to the invention thus is able, as a wide-band damper so to speak, to cover a wide frequency spectrum which includes large parts of the sound frequencies that are audible for the human ear, thus the audible sound between 50 Hz and 5 kHz, preferably between 50 Hz and 6500 kHz and above.

In order to be able to connect the silencer, in addition to its dampening effect, to an acoustic resonator which allows influencing the resonant frequency of a generic intake system in an advantageous manner, the silencer can be provided with an appropriately shaped fluidic connector. Under the condition of a suitable design, for example as a hollow-cylindrical plug connection or a pair of such plug connections with a predefined axis arrangement, such a silencer can be coupled in many different combinations to known cavity resonators such as, e.g. a Helmholtz resonator or other resonators such as, e.g., $\lambda/4$ pipes which enable optimizing the device for various individual frequencies. In this case, an uncomplicated constructional implementation is the result of the integral formation of the connecting element or connecting elements with the pipe.

The resonator is preferably arranged spaced apart from the silencer. As a result, the perforation of the outer casing, at least in regions, remains advantageously completely free and is not covered by the resonator. Such a configuration is in particular possible because the silencer, in particular the outer casing, needs no space, in particular no resonator, surrounding the silencer for achieving the desired sound absorption.

The spaced arrangement of the resonator can be achieved by an appropriate configuration of the associated connecting elements. The latter, for example, can project from the silencer and extend in particular transverse, preferably perpendicular, to the flow direction of the gas mixture in the pipe from the silencer. As a result and, advantageously, a resonator arrangement provided transverse, in particular perpendicular, to the flow direction of the gas mixture is possible. Through this, an improved absorption behavior and a favorable flow of the gas mixture, namely independent of the configuration of the silencer, are achieved.

Here, the connecting elements are preferably arranged spaced transverse and/or offset to the flow direction of the gas mixture in the pipe in order to achieve a better interaction and/or to improve the overall absorption. This also improves the flow of the gas mixture or conducting the flow because the influence of the connecting elements on one another is reduced. Moreover, such a configuration can contribute to a space-saving design of the silencer.

Also, of advantage are configurations in which the connecting elements are fluidically connected to the pipe. This connection is preferably established in connection regions of the pipe. This means that the respective connecting element is preferably assigned at least one such connecting region.

In an advantageous variant, at least one of the connection regions is perforated. Such a variant has in particular the advantage that the advantageous properties of the perforation in the connecting region do not need to be dispensed with. Moreover, improved interaction with the associated connection and in particular with the resonator is achieved. In addition, this results in fluidic advantages, in particular because no unfavorable flows are generated in the connecting region. Particularly preferred, all connecting regions are perforated.

Preferably, at least one of the connection regions is perforated differently from the remaining perforated region of the pipe. This can be achieved in that in the at least one connecting region, the number and/or density and/or size of perforation holes is different than in another region. It can be provided that the perforation holes in the connecting region are larger. In particular, the perforation holes in the connecting region are at least twice as large as in another region. For example, such a perforation hole in the connecting region can have a diameter of 5 mm, while such a perforation hole in another region has a diameter of 2 mm.

In an advantageous refinement, at least one of the connecting regions is arranged in a bent section of the pipe. This means that the connecting region is bent. The bent configuration of the connecting region results in a corresponding flow of the gas mixture in the pipe.

Advantageously, the connecting region is bent in such a manner that the flow into the connecting region is made simpler. This is implemented, for example, in that the connecting region is bent towards the associated connecting element.

Further important features and advantages of the invention arise from the sub-claims, from the drawings and from the associated description of the figures based on the drawings.

It is to be understood that the above-mentioned features and the features still to be explained hereinafter are usable not only in the respective mentioned combination, but also in other combinations or alone, without departing from the context of the present invention.

Preferred embodiments of the invention are illustrated in the drawings and are explained in greater detail in the following description.

BRIEF DESCRIPTION OF THE DRAWINGS

In the figures, schematically

DETAILED DESCRIPTION

Figure 1:
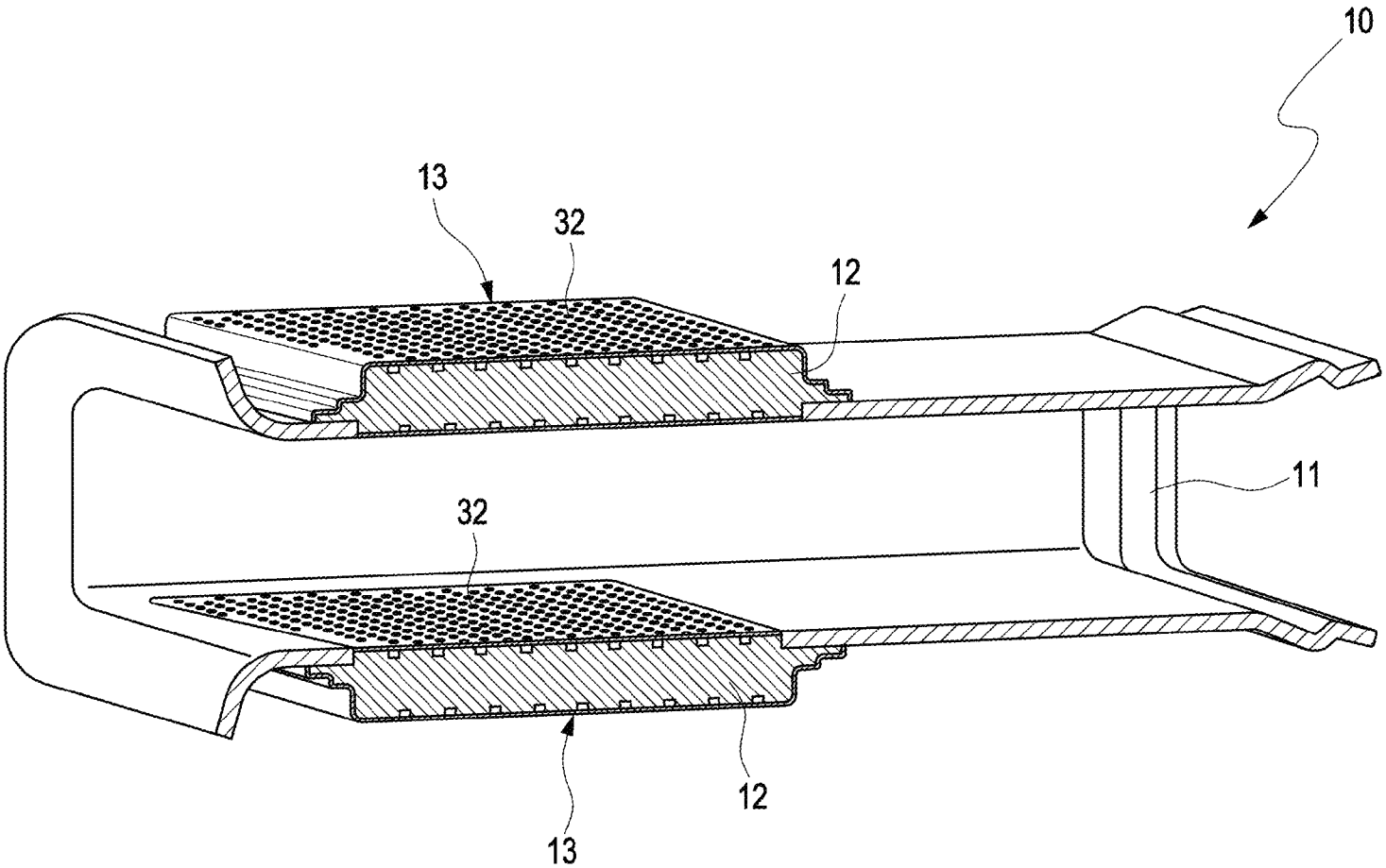
FIG. 1 shows a cross-section of a silencer according to a first embodiment of the invention.

FIG. 1 illustrates a silencer 10 according to a first embodiment according to the invention by means of a sectional view. The term "silencer" in the present context is to be understood as any device for reducing sound emissions, which comprises in particular intake silencers in motor vehicles in addition to mufflers for reducing exhaust noises. However, so-called cross-talk sound attenuators or splitters as those used in building technology in ventilation ducts or air-conducting channel systems are principally also to be understood as silencers.

The core of the silencer 10 is formed by a pipe 11, the cross-section of which corresponds approximately to a rounded rectangle. The walls of the pipe 11 are composed of a substantially fluid-tight material which is particularly suitable for conveying air. Further (non-illustrated) molded pipes, expansion joints, valves, seals, connecting elements such as flanges, fittings, screw connectors, sockets and fastener elements for support may supplement the pipe 11 in a known arrangement.

As can be seen from the longitudinal section of FIG. 1, the pipe 11 is surrounded on two sides along a subsection by an absorption layer 12 which is formed by two acoustic panels embedded in opposing wall surfaces of the pipe 11. Alternatively, a circumferentially arranged absorption layer 12 applied on the outside is also conceivable. In this case, a porous sound-absorbing material with through-pores, for example, a suitable melamine resin foam or another foam, serves as an absorber. Foam, in a broad literal sense, is to be understood as any material having a cell structure and low density which is produced in a substantially artificial manner. Likewise, included are in particular chemically, physically or mechanically foamed materials which are well known to the person skilled in the art and which are used in the field of plastics processing.

The absorption layer 12, for its part, is surrounded by an outer casing 13 which presses the foam against the inner pipe 11 and fixes the foam in its position. The pipe 11 as well as the outer casing 13 is perforated in such a manner that their respective perforation holes 32 are slightly offset to one another in the radial direction of the pipe 11. Apart from that, the arrangement, quantity, shape and size of the perforation holes 32 are selected such that they provide the silencer 10 with a higher absorption degree with respect to lower audible sound frequencies.

In the example shown, a uniform distribution of perforation holes 32 can be seen in each case on the outer casing 13 and the pipe 11. The respective perforation hole 32 can have a size or a diameter of approx. 2 mm.

Figure 2:
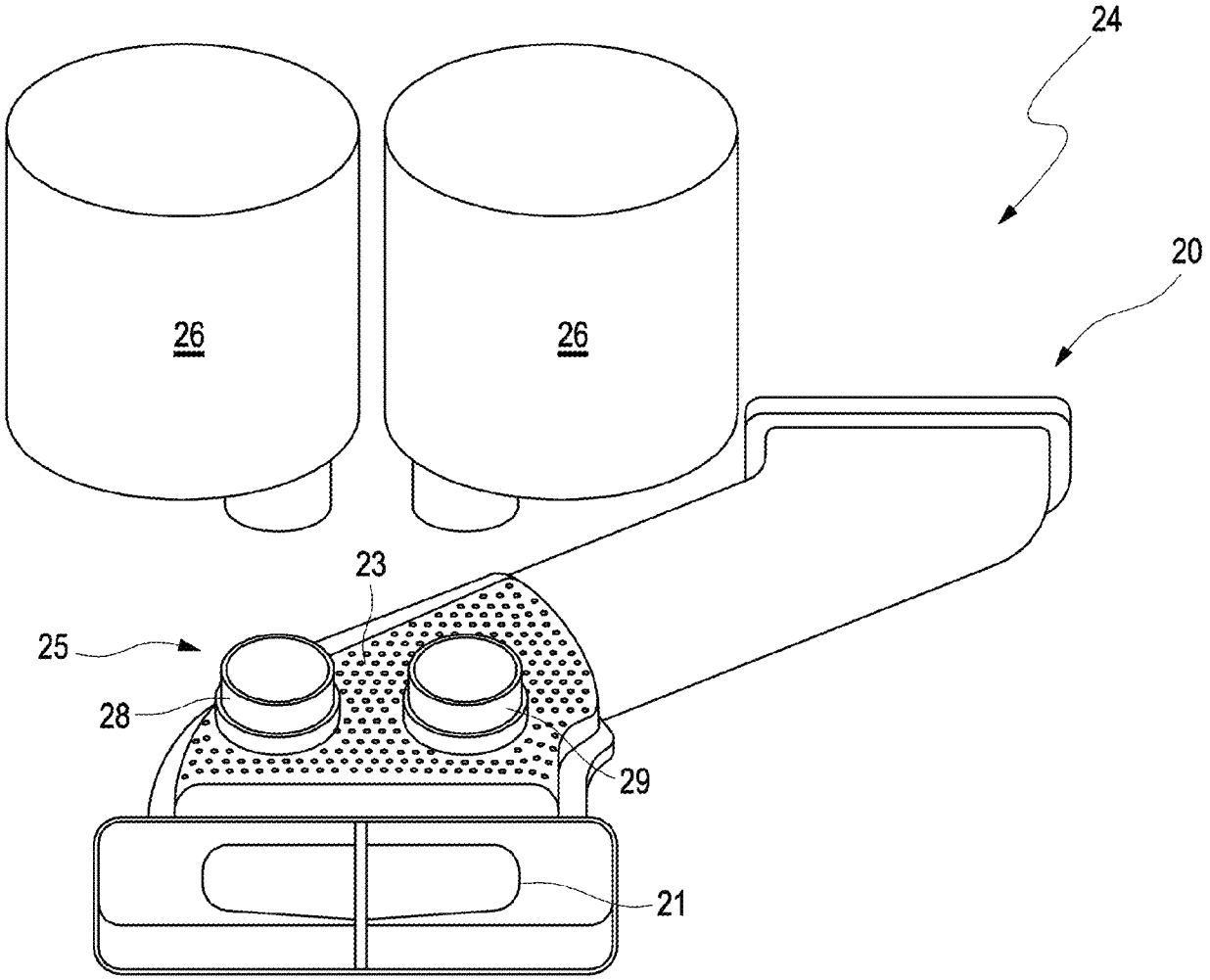
FIG. 2 shows a view of an intake system with a silencer according to a second embodiment of the invention.
Figure 3:
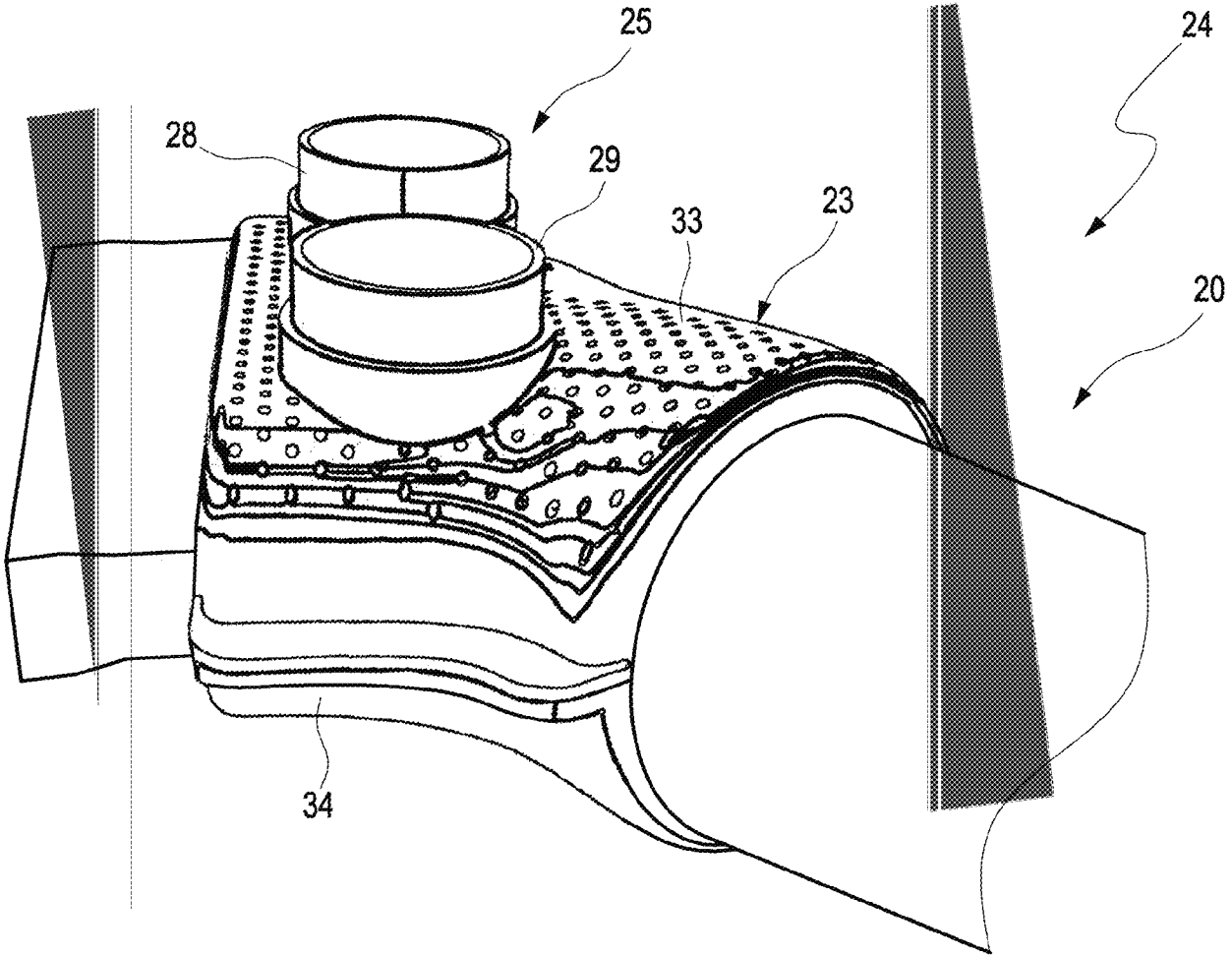
FIG. 3 shows a partial perspective view of the silencer of FIG. 2.
Figure 4:
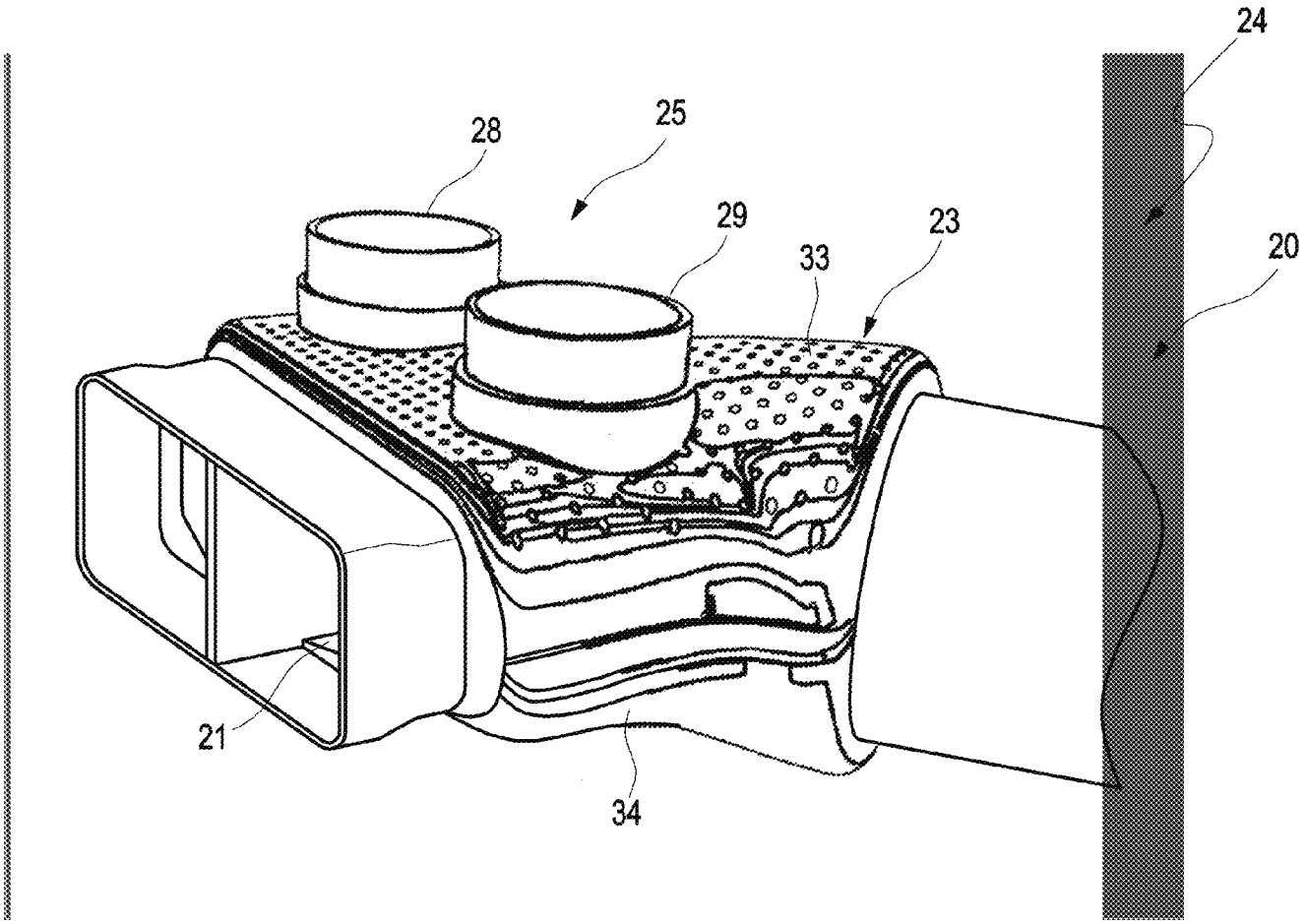
FIG. 4 shows another partial perspective view of the silencer of FIG. 2.

FIGS. 2, 3 and 4 show a second embodiment according to the invention of a silencer 20, which now functions as an intake silencer that is part of an intake system 24 for an internal combustion engine in the form of a diesel engine. For this purpose, the intake silencer 20 can be connected to the combustion chambers of cylinders of the diesel engine, for example via an optionally controllable intake line, and can supply the fresh gas needed for the combustion process to said combustion chambers. For additional damping of the intake noises and for cleaning of the raw intake air, the intake silencer 20 can also be equipped with a suitable air filter (not illustrated) in the form of a paper filter or dry air filter, a wet air filter or oil bath filter, which potentially reduces wear on the piston, piston rings, cylinder running surfaces and bearings of the diesel engine. In an alternative embodiment, which is not shown, in which the silencer according to the invention is used in connection with a gasoline engine, the intake system 24 can include additional components for preheating the intake air and for the injection of fuel, for example by means of a mechanically or electromagnetically actuated injection valve.

Furthermore, in the present embodiment, two pipe-shaped connecting elements 28, 29, which are aligned axially parallel, are formed on the pipe 21 of the intake silencer 20. Due to their hollow-cylindrical shape and their specific arrangement, these connecting elements 28, 29 add to the intake silencer 20 a fluidic connector 25 for an acoustic resonator 26 (shown only in FIG. 2), which can establish a plug connection with the intake silencer 20 via a corresponding mating connector.

The resonator 26 is arranged spaced apart from the pipe 21 and the outer casing 23 and is oriented transverse to the flow direction of the gas mixture in the pipe 21.

In the view according to FIG. 3, the production method used for manufacturing the intake silencer 20 becomes apparent. Thus, it becomes clear that the outer casing 23 is formed by the combination of two half shells 33, 34 which are joined together along a flange and between which the sound-absorbing material, which is covered in FIG. 3 by the outer casing 23, is pressed against the pipe 21. The pipe 21 can also be implemented as a half shell construction formed from two substantially identically shaped modules 35, wherein optional spacers to be inserted between the half shells 33, 34 allow adapting the intake silencer 20 to absorption layers of different thicknesses.

Figure 5:
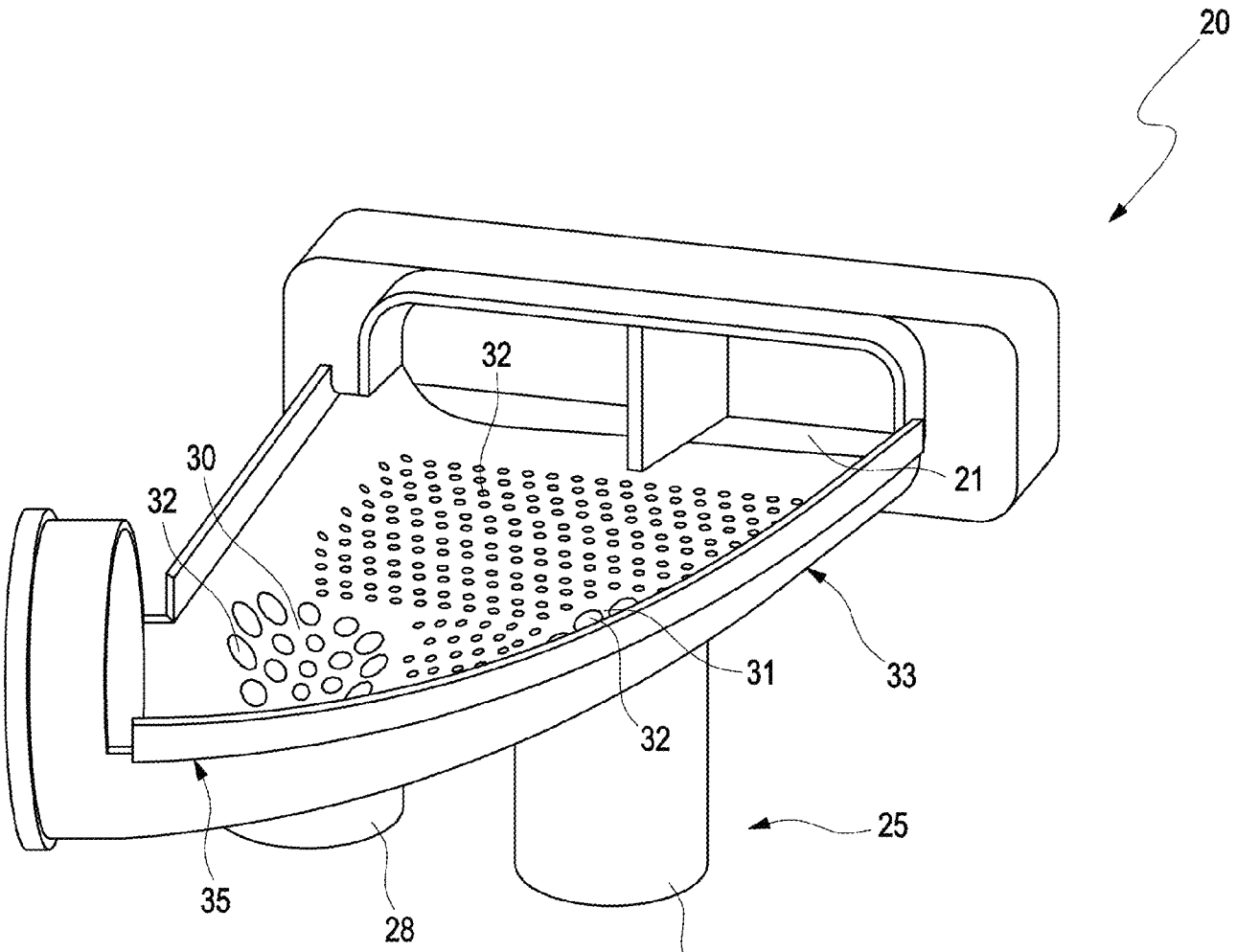
FIG. 5 shows a spatial view of a section through the silencer.

FIG. 5 shows a section through such a silencer 10, 20. Shown here is the first half shell 33 for fabricating the outer casing 23, which comprises the first connecting element 28 and the second connecting element 29, which are integrally molded on the first half shell 33 and therefore are integrally molded on the silencer 20. Also, shown is such a half-shell-like module 35 for fabricating the pipe 21, which, together with a half-shell-like second module, which is not shown here, forms the pipe 21.

The fluidic connection between the first connecting element 28 and the pipe 11 is implemented via a first connecting region 30 of the first module 35 and thus of the pipe 21. The same applies to the second connecting element 29 which is fluidically connected to the pipe 21 via a second connecting region 31 of the first module 35 or the pipe 21. Due to the cylindrical shape of the connecting elements 28, 29, the connecting regions 30, 31 are circular in a top view in the direction of the axis of the associated connecting element 28, 29.

The first connecting region 30 and the second connecting region 31 are at least partially bent. This means that the connecting regions 30, 31 are arranged in a bent section of the first module 35 or the pipe 21. Here, this bend is implemented by forming the first module 35 in such a manner that it is convex with respect to the connecting elements 28, 29. This means that the first module 35 and/or the pipe 21 in the respective connecting region 30, 31 is bent towards the associated connecting element 30, 31.

Furthermore, it can be seen in FIG. 5 that the connecting regions 30, 31 are perforated. The connecting regions 30, 31 are perforated differently from other perforated regions of the pipe 21. In the example shown, this other perforation is implemented by forming larger perforation holes 32 in the connecting regions 30, 31.

It can be seen in the FIGS. 2 to 5 that the connecting elements 28, 29 are arranged spaced apart. Accordingly, the connecting regions 30, 31 are also spaced apart. The connecting elements 28, 29 are arranged spaced apart or offset transverse to the flow direction of the gas mixture in the pipe 11, 21. Moreover, it can be seen that the alignment of the connecting elements 28, runs transverse to the flow direction of the gas mixture in the pipe 21. This means that the connecting elements 28, 29 project transverse to the flow direction from the silencer 20.

The invention claimed is:

1. A production method for a silencer, comprising:

providing a pipe having a perforated region and a perforated connection region;

providing a first half shell and a second half shell, wherein at least one of the first half shell and the second half shell has a perforated region;

disposing a hollow connecting element on the first half shell to provide a fluidic connector for communicating fluid in the pipe, the hollow connecting element having an axis extending through the perforated connection region pressing a porous sound-absorbing material between the pipe and at least one of the first half shell and the second half shell to form an absorption layer sandwiched between the perforated region of the pipe and the perforated region of the at least one of the first half shell and the second half shell;

joining the first half shell and the second half shell together to form an outer casing enclosing the pipe and surrounding the absorption layer;

wherein the perforated connection region defines a fluidic connection between the pipe and the hollow connecting element.

2. The method according to claim 1, wherein providing the pipe includes disposing a configuration of perforation holes in the perforated region and another configuration of perforation holes in the perforated connection region, the other configuration of perforation holes in the perforated connection region structured differently than the configuration of perforation holes in the perforated region to facilitate fluid communication between the hollow connecting element and the pipe.

3. A silencer, comprising:

a pipe having an axis for conducting a gas mixture, wherein the pipe is perforated with a plurality of perforation holes in at least one region;

an absorption layer at least partially surrounding the pipe for absorbing a sound transmitted by the gas mixture;

an outer casing at least partially encasing the pipe, wherein the outer casing is perforated with a plurality of perforation holes in at least one region and the outer casing surrounds the absorption layer; and a fluidic connector to provide a fluid coupling for the pipe, wherein the fluidic connector includes at least one hollow connecting element disposed on the pipe and in fluid communication with the gas mixture.

4. The silencer according to claim 3, wherein the pipe has at least one perforated connection region defining a fluidic connection between the pipe and the at least one hollow connecting element, and wherein the at least one perforated connection region includes a plurality of other perforation holes having a flow cross-section sized larger than that of the plurality of perforation holes in the at least one region of the pipe to facilitate a fluid flow through the at least one perforated connection region.

5. The silencer according to claim 3, wherein the plurality of perforation holes of the pipe and the plurality of perforation holes of the outer casing are arranged partially offset to one another in a radial direction of the pipe.

6. The silencer according to claim 3, wherein the absorption layer is composed of a material capable of substantially completely absorbing the sound in a high frequency range.

7. The silencer according to claim 3, wherein the pipe is perforated in a configuration facilitating a change in a buildup of resonant frequencies and a reduction of an outlet sound in low frequency ranges, and wherein the configuration includes at least one of:

a uniform distribution of the plurality of perforation holes disposed in the pipe;

the plurality of perforation holes disposed in the pipe have a round shape; and at least two of the plurality of perforation holes disposed in the pipe have the same shape.

8. The silencer according to claim 3, further comprising an acoustic resonator coupled to the at least one connecting element for influencing the sound transmitted by the gas mixture, wherein the acoustic resonator is arranged transverse to a flow direction of the gas mixture in the pipe and spaced apart from the pipe and the outer casing.

9. The silencer according to claim 3, wherein the at least one connecting element has a hollow-cylindrical structure and projects radially from the pipe.

10. The silencer according to claim 9, wherein the at least one connecting element has an axis that extends substantially perpendicular to a flow direction of the gas mixture in the pipe.

11. The silencer according to claim 9, wherein the at least one connecting element is a first connecting element, and wherein the fluidic connector further includes a hollow-cylindrical second connecting element in fluid communication with the gas mixture and arranged axially parallel to the first connecting element.

12. The silencer according to claim 11, wherein the first connecting element and the second connecting element are arranged spaced apart transverse to a flow direction of the gas mixture in the pipe.

13. The silencer according to claim 11, wherein the pipe has a first connecting region fluidically connected to the first connecting element and a second connecting region fluidically connected to the second connecting element.

14. The silencer according to claim 13, wherein at least one of the first connecting region and the second connecting region is perforated with a plurality of other perforation holes.

15. The silencer according to claim 14, wherein the plurality of other perforation holes of the at least one of the first connecting region and the second connecting region are structured differently from the plurality of perforation holes disposed in the at least one region of the pipe.

16. The silencer according to claim 14, wherein the at least one of the first connecting region and the second connection region is arranged in a bent section of the pipe to facilitate a flow of the gas mixture therethrough.

17. The silencer according to claim 15, wherein the plurality of other perforation holes are different in at least one of number, density and size than the plurality of perforation holes disposed in the at least one region of the pipe.

18. A silencer for an engine intake, comprising:

a pipe for conducting a fluid flow, the pipe having at least one perforated region including a plurality of perforation holes;

an absorption layer at least partially surrounding the pipe in the at least one perforated region for absorbing a sound transmitted by the fluid flow, the absorption layer composed of a porous sound-absorbing material;

an outer casing at least partially encasing the pipe and surrounding the absorption layer, the outer casing having at least one perforated region including a plurality of perforation holes;

wherein the absorption layer is sandwiched between the at least one perforated region of the pipe and the at least one perforated region of the outer casing; and wherein the pipe has at least one perforated connection region to provide a fluidic connection for the pipe, the at least one perforated connection region including a plurality of other perforation holes structured differently from the plurality of perforation holes of the at least one perforated region of the pipe.

19. The silencer according to claim 18, further comprising a fluidic connector to provide a fluid coupling for the pipe, wherein the fluidic connector includes at least one hollow connecting element fluidly connected to the at least one perforated connection region, the at least one perforated connection region defining the fluidic connection between the pipe and the at least one hollow connecting element, and wherein the at least one hollow connecting element projects from the outer casing transverse to a flow direction of the fluid flow.

20. The silencer according to claim 18, wherein at least some of the plurality of other perforation holes of the at least one perforated connection region have a flow cross-section sized larger than the plurality of perforation holes of the at least one perforated region of the pipe to facilitate communicating the fluid flow through the at least one perforated connection region.

* * * * *